US007922594B2

(12) United States Patent
Verl et al.

(10) Patent No.: US 7,922,594 B2
(45) Date of Patent: Apr. 12, 2011

(54) AMUSEMENT RIDE

(75) Inventors: Alexander Verl, Ludwigsburg (DE); Gino De-Gol, Warwick (GB); Niko Croon, Stuttgart (DE)

(73) Assignees: Alexander Verl, Ludwigsburg (DE); Gino De-Gol, Warwick (GB)

( * ) Notice: Subject to any disclaimer, the term of this patent is extended or adjusted under 35 U.S.C. 154(b) by 277 days.

(21) Appl. No.: 12/352,617

(22) Filed: Jan. 13, 2009

(65) Prior Publication Data

US 2009/0181781 A1 Jul. 16, 2009

(30) Foreign Application Priority Data

Jan. 14, 2008 (DE) ..... 10 2008 005 859

(51) Int. Cl.
*A63G 31/00* (2006.01)

(52) U.S. Cl. ..... 472/131; 472/137

(58) Field of Classification Search ..... 472/131, 472/137

See application file for complete search history.

(56) References Cited

U.S. PATENT DOCUMENTS 4,775,144 A * 10/1988 Shipman ..... 472/44
4,807,869 A * 2/1989 Knijpstra ..... 472/45
5,421,783 A * 6/1995 Kockelman et al. ..... 472/135
5,649,866 A * 7/1997 Balwanz ..... 472/118

* cited by examiner

*Primary Examiner* — Gene Kim
*Assistant Examiner* — Michael D Dennis
(74) *Attorney, Agent, or Firm* — Gudrun E. Huckett

(57) ABSTRACT

An amusement ride has guides and at least one carriage movable along the guides. At least three first arms each having a first end and a second end are provided, wherein the first ends are connected pivotably to the at least one carriage. First drives are provided that each are movable along one of the guides, respectively, independently from one another. The at least three first arms are pivotably connected with the second ends to the first drives so that the at least one carriage and the first drives are pivotably connected to one another.

25 Claims, 5 Drawing Sheets

AMUSEMENT RIDE

BACKGROUND OF THE INVENTION

The invention relates to an amusement ride comprising at least one carriage that is movable along guides.

Amusement rides are known in which the guides are in the form of rails on which the carriages ride; the carriages have seats for passengers. In such amusements rides the movement of the carriages is predetermined by the course of the guides.

When it is desired that the carriages perform complex movements it is known to arrange the carriages on a wobbling disk and to have the carriages rotate about an axle. By overlay of the wobbling movement of the wobbling disk and the rotational movement of the carriage on the wobbling disk, a great variety of movements of the carriage are achieved. However such rides are complex and therefore expensive.

SUMMARY OF THE INVENTION

It is an object of the present invention to design an amusement ride of the aforementioned kind in such a way that the carriages during their ride can perform movements of a wide variety and/or can move at different speeds and accelerations.

In accordance with the present invention, this is achieved in that at least three arms are attached on the carriage in a pivotable way and connect the carriage with drives in a pivotable way, which drives can move independent from one another along a guide, respectively.

In the amusement ride according to the invention the carriages are thus pivotably connected by the three arms to the drives that independent from one another can move along a guide, respectively. As a result of the pivotable connection of the carriages to the arms it is possible to bring the carriages into a variety of positions and orientations. This is possible simply in that the drives move independent from one another along the guides. The driving speed of the drives can be adjusted relative to one another such that the carriages will assume the desired positions or orientations during the ride. Also, the driving speed of the drives can be adjusted, even independent from one another, so that the carriages can be moved at a wide variety of speeds in any position or orientation.

In a preferred embodiment the guides are vertical columns along which the carriages can be moved in the vertical direction. In this connection it is possible, for example, to first accelerate the carriages as they travel upwardly. After a motion reversal of the carriages they are accelerated for a certain amount of time such that the passengers in the carriages experience a weightless state. It is thus possible to simulate by means of the amusement ride according to the invention a weightless state for the passengers as in the past could be achieved only by airplanes that at great altitude fly downwardly at an appropriate high speed. The use of such airplanes however entails extreme cost expenditure. In the amusement ride according to the invention a weightless state can be achieved without problems without this requiring a constructively complex and expensive configuration.

DESCRIPTION OF THE PREFERRED EMBODIMENTS

Figure 2:
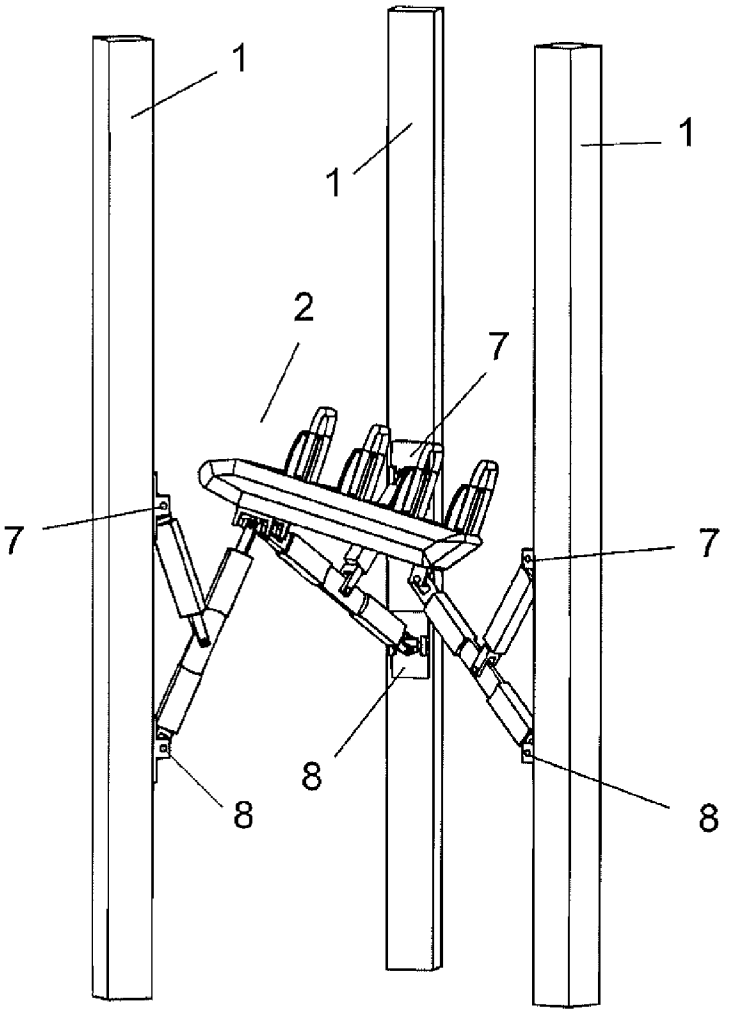
FIG. 2 is a further view of the amusement ride according to FIG. 1.
Figure 1:
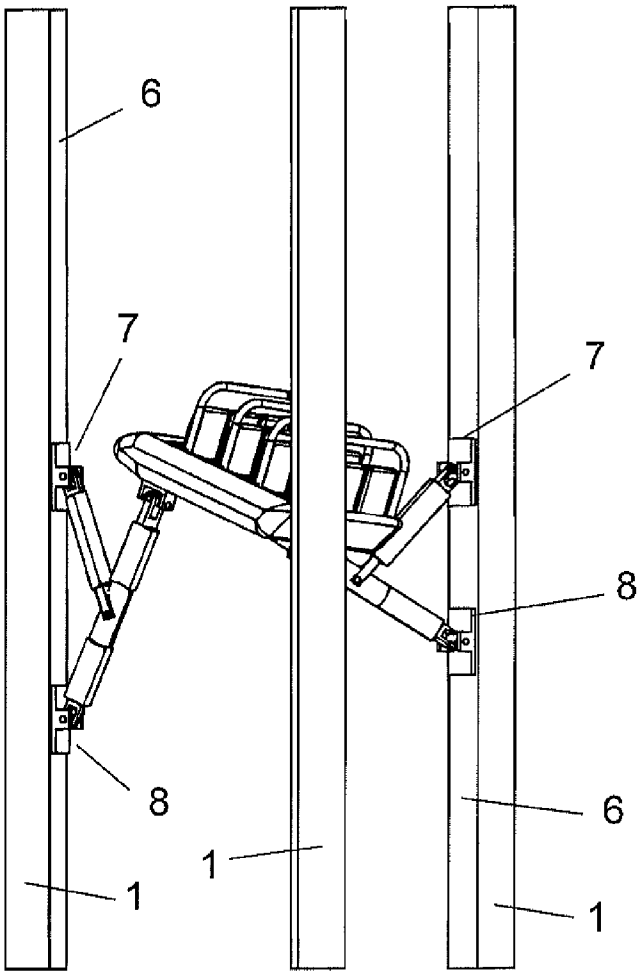
FIG. 1 is a side view of an amusement ride according to the invention.

The amusement ride has three vertical columns 1 that extended at a spacing relative to one another parallel to one another and between which a carriage is movable in the vertical direction. The carriage 2 has a support body 3 on which seats 4 are mounted. In the illustrated embodiment four rows of seats are provided that each have three seats 4. Each row of seats is provided for the protection of the passengers with a roll bar 5.

The carriage 2 can move along the columns 1 in a way to be described in the following. Each column 1 is provided for this purpose with a rail 6 (FIG. 3) that extends across the length of the columns 1 and along which two drives 7, 8 are movable, respectively. At the upper drives 7 the upper end of an arm 9 is pivotably attached, respectively. The lower end of the arms 9 is connected to an arm 10, respectively, so as to be pivotable about horizontal axle 11. The lower end of the arms 10 is pivotably connected to the lower drive 8 while the upper end of the arm 10 is connected pivotably to the bottom side of the support body 3 of the carriage 2. The arms 9, 10 each have a constant (unchangeable) length. Together with the drives 7, 8 they form so-called lambda drives 12 with which the carriages 2 can be moved along the column 1.

The arms 9, 10 each are connected to the drives 7, 8 so as to be pivotable about horizontal pivot axles 13, 14. The pivot axles 13, 14 are positioned parallel to one another and to the pivot axle 11 with which the arms 9 are connected to the arms 10. In the area of attachment of the arms 9 the arms 10 are advantageously flattened. The arms 9 engage these flattened parts with a connecting element in the form of a fork structure 15 that is supported so as to be rotatable about an axis 16 extending in the longitudinal direction of the arm 9.

At the upper end, the arm 9 is provided with another connecting element in the form of a fork structure 17 (FIG. 3) that is supported so as to be rotatable about an axis 18 extending in the longitudinal direction of the arm 9. The legs of the fork structure 17 are penetrated by an axle 19 that extends perpendicularly to the pivot axle 13; the arms 9 are pivotable about the axle 19, respectively. The axle 19 is arranged in a bearing 20 that is rotatably supported on the pivot axle 13.

Figure 3:
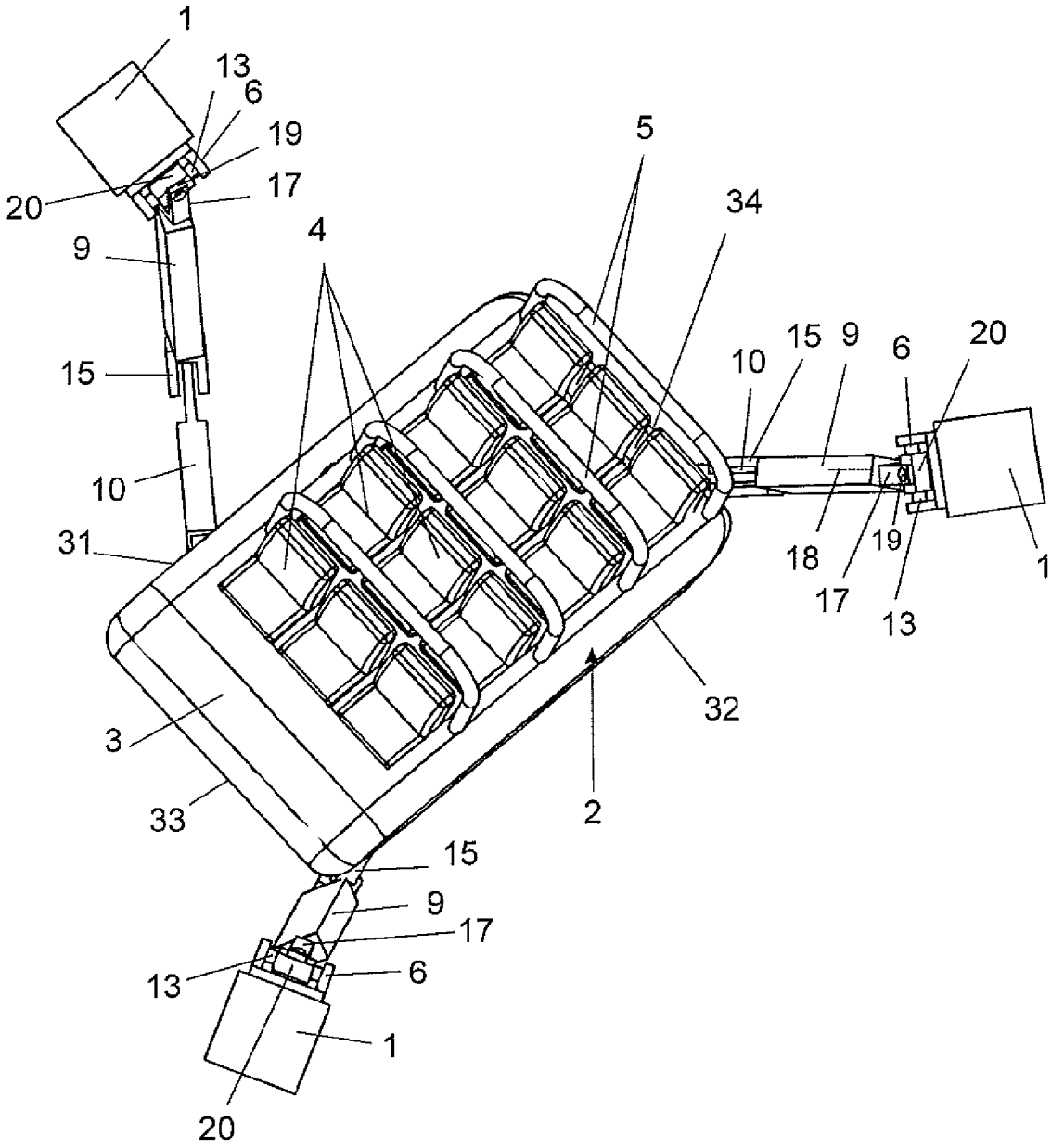
FIG. 3 is a top plan view of the amusement ride according to the invention.
Figure 4:
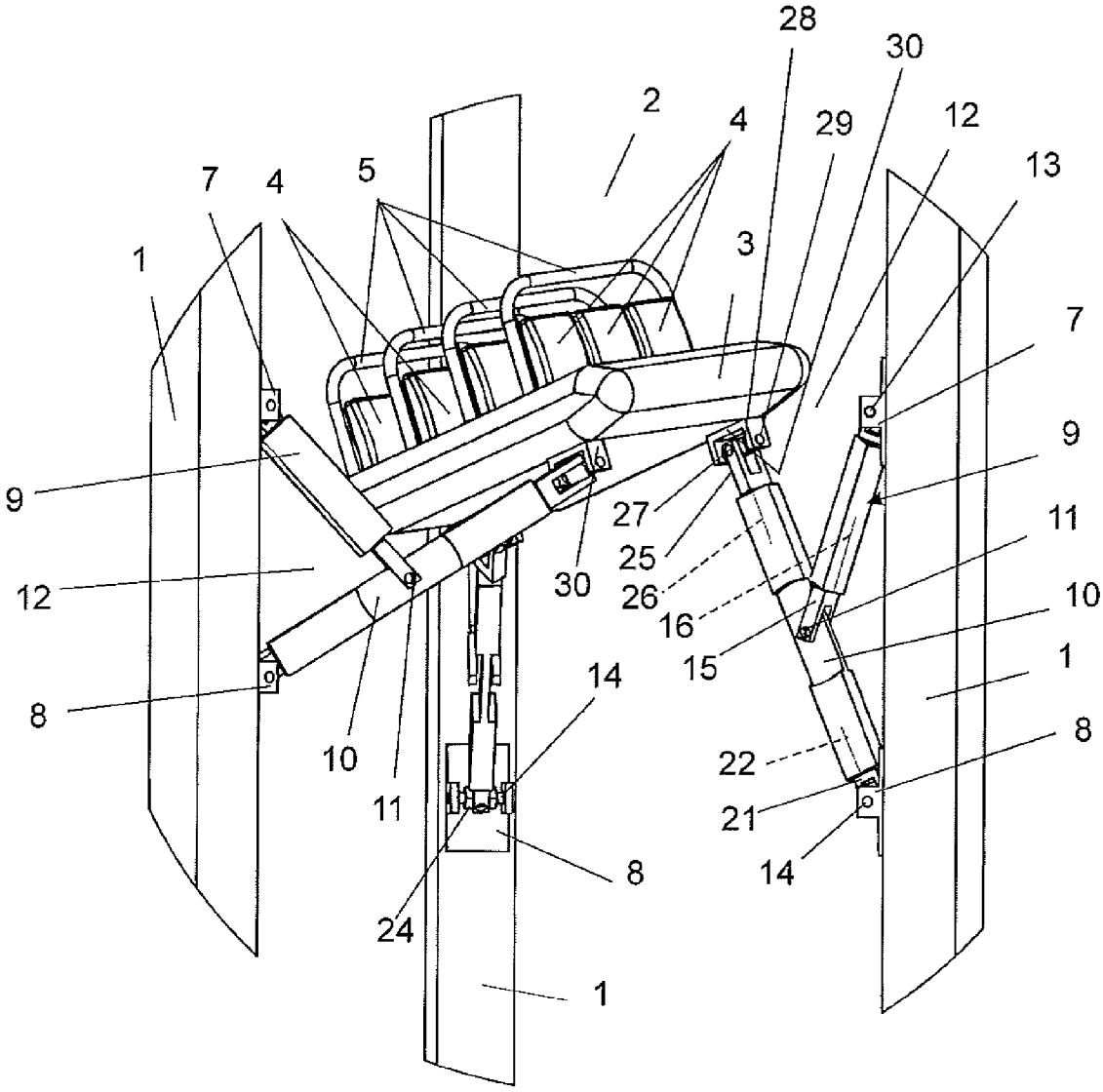
FIG. 4 is a detail view of a carriage of the amusement ride according to the invention which carriage is movable along three columns in a vertical direction.

In this way, the arms 9 can pivot or swivel about the pivot axle 13 and the pivot axle 19 relative to the drive 7, respectively. Moreover, the fork structure 17 enables that the arms 9 can be rotated about the axis 18 that is perpendicular to the pivot axle 13 and pivot axle 19. Since the arms 9 are also rotatable about the axis 16 relative to the fork structure 15, the arms 9 can be adjusted into the required positions when the carriage 2 is being moved for the ride. FIG. 3 shows for a certain position of the carriage 2 the various positions of the arms 9 that result because of the position and orientation of the carriage 2 illustrated in FIG. 3.

The arms 10 are adjustably connected to the drives 8 in the same way as the arms 9 to the drives 7 and are also connected to the support body 3 so as to pivot or swivel about several axes. The lower end of the arms 10 are provided with a connecting element in the form of a fork structure 21 that is rotatably supported on the arm 10 about an axis 22 extending in the longitudinal direction of the arm 10. The fork structure 21 is seated on axle 23 that penetrates the fork legs and is secured in a bearing 24 that is rotatably supported on the pivot axle 14. The upper end of each arm 10 is provided with a connecting element in the form of a fork structure 25 that is rotatably supported on the arm 10 about an axis 26 extending in the longitudinal direction of the arm 10. The fork legs are penetrated by axle 27 that is arranged in the bearing 28 and is rotatably supported on the pivot axle 29. The two pivot axles 27, 29 are positioned perpendicularly to one another as are the pivot axles 14, 23 at the lower end of the arm 10. The pivot axles 29 are attached to the legs of a connecting member in the form of a U-shaped bracket 30, respectively, that is provided at the bottom side of the support body 3 of the carriage 2. As illustrated in FIG. 3, two brackets are located at oppositely positioned longitudinal sides 31, 32 so as to neighbor a narrow side 33 of the carriage 2. A third bracket is positioned closely adjacent to the oppositely positioned narrow side 34 with minimal spacing to the longitudinal side 32 of the carriage 2. As a result of the described pivot connection between the arms 10 and the brackets 30, the arms 10 when moving the carriage 2 can assume any position along the columns 1 relative to the carriage 2 as well as the drive 8.

Figure 7:
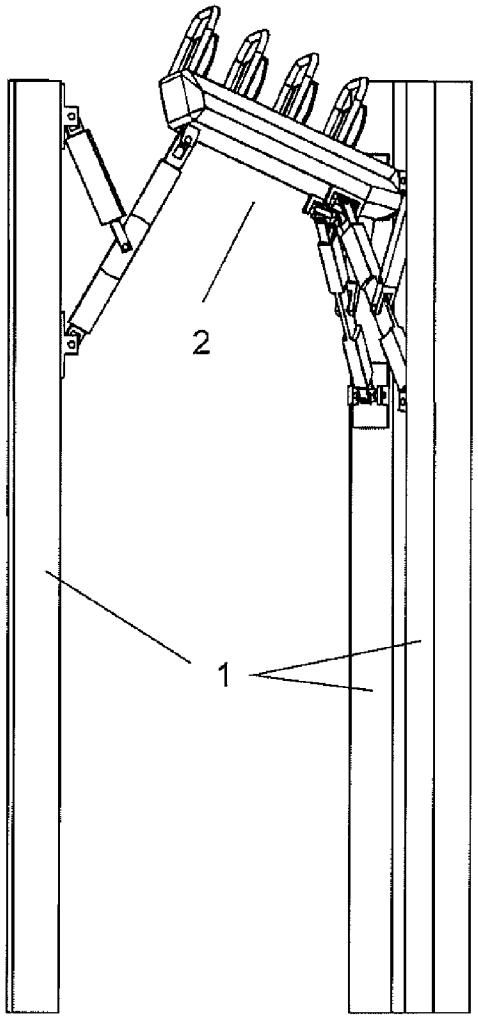
FIG. 7 shows a third stage of the motion of the carriage upon reaching the upper end of the columns of the amusement ride according to the invention.
Figure 6:
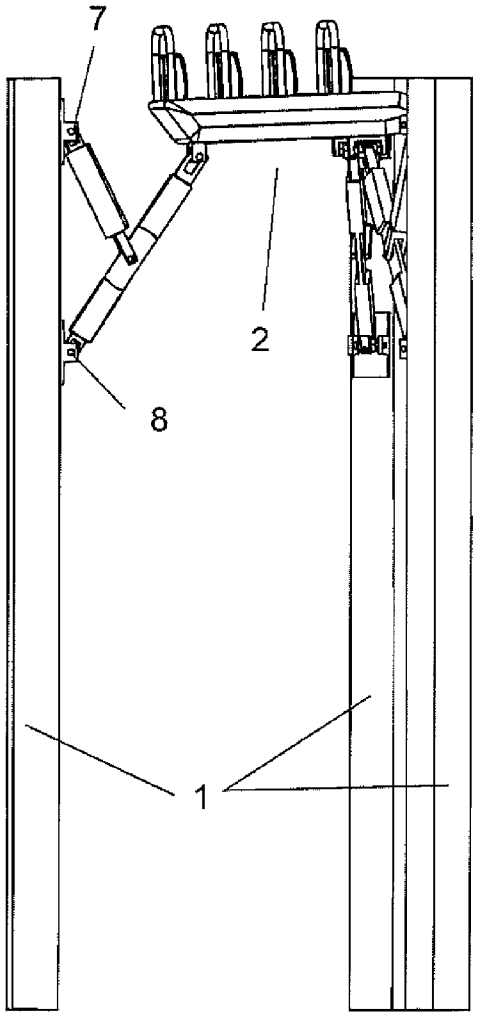
FIG. 6 shows a second stage of the motion of the carriage upon reaching the upper end of the columns of the amusement ride according to the invention.
Figure 5:
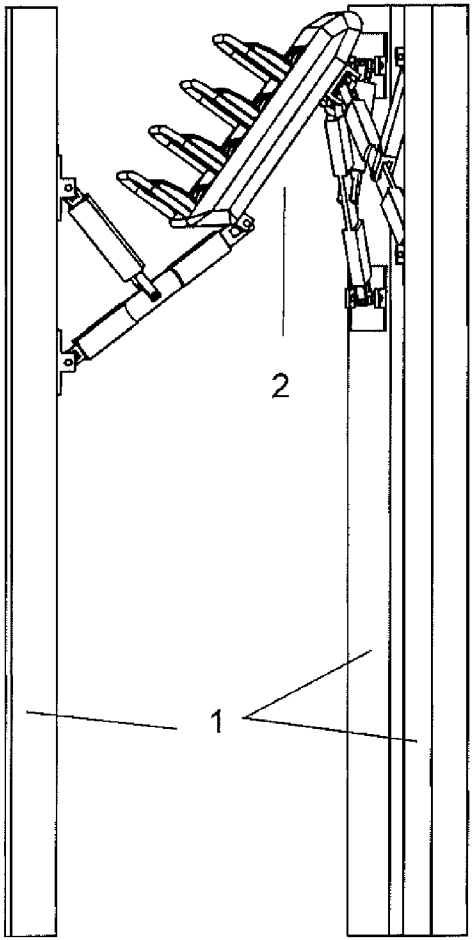
FIG. 5 shows a first stage of the motion of the carriage upon reaching the upper end of the columns of the amusement ride according to the invention.

The two drives 7, 8 of each column 1 can move independent from one another along the columns 1 in as much as the pivot or swivel joints between the arms 9 and 10 allow this. The two drives 7, 8 can also moved jointly along the column 1. Since the drives 7, 8 of each column 1 can be controlled independent from one another, the carriage 2, as it moves along the columns 1, can be moved into a wide variety of positions. The FIGS. 5 to 7 illustrated in an exemplary fashion the carriage 2 in various positions shortly before reaching the upper end of the columns 1 (FIG. 5), just having reached the upper end of the columns 1 (FIG. 6), and upon downward movement shortly after having reached the upper end of the columns 1 (FIG. 7). In the illustrated embodiment the drives 7, 8 are controlled such that the carriage 2 assumes a steeply upwardly inclined position. Of course, it is also possible to control the drives 7, 8 in such a way that the carriage 2, for upward vertical movement along the columns 1, assumes a horizontal position, for example, or a less slanted position. As soon as the carriage 2 approaches the upper end of the columns 1, the two drives 7, 8 positioned to the right in FIGS. 5 to 7 are stopped while the drives 7, 8 of the left column 1 are moved farther upwardly. Since the two oppositely positioned drives are standing still, the carriage 2 is moved from the upwardly slanted position into a horizontal position (FIG. 6). In this position the upper drives 7 of the columns 1 have reached their upper end position. The drives 7, 8 of the left column 1 now remain in their upper end position while the oppositely positioned two drives 7, 8 move along the columns 1 in the downward direction. This has the result that the carriage 2 assumes a downwardly slanted position. The slant angle is determined by the amount of time it takes for the drives 7, 8 of the left column 1 to also be moved downwardly.

At the lower end of the columns 1 a corresponding reversal of the movement direction of the drives 7, 8 on the three columns 1 is realized so that the carriage 2 by passing through a horizontal intermediate position will assume again the slanted upward orientation in accordance with FIG. 5. In the lower end position the drives 7, 8 can be stopped when the carriage 2 has reached its horizontal position. It is then possible for the passengers to exit the carriage 2 or to enter the carriage 2.

In the described exemplary course the drives 7, 8 of the two right columns 1 are driven in the same way in accordance with FIGS. 5 to 7 so that the carriage 2 is moved in a translatory movement upwardly or downwardly in a slanted position. However, the drives 7, 8 of the two right columns 1 can also be moved differently relative to one another along the columns so that the carriage 2 is not only slanted upwardly but also sideways. By combining the action of all drives 7, 8 of the three columns 1 the carriage can be brought into a wide variety of positions during the ride. It is even possible to e.g. continuously change the position of the carriage 2 during the ride in that alternatingly one or two drives are moved along their columns at changing speeds.

The drives 7, 8 can be linear drives with which a reliable operation of the amusement ride is ensured. For moving the carriage 2 it is also possible to employ a ball spindle or cable traction system that is connected to drive elements that are movable along the rails 6 of the columns 1.

Instead of the lambda drives 12 it is also possible to use, for example, toggle joints or even straight rods that engage the carriage 2. In these alternative embodiments for connecting the carriage 2 to the drives it is ensured that the carriage 2 can be brought into a variety of positions and orientations.

In the described embodiment six degrees of freedom for the carriage 2 can be adjusted as needed so that the position and orientation of the carriage 2 can be controlled independent from one another.

By means of the drives 7, 8 very high accelerations can be achieved. For safety reasons with regard to the passengers, the acceleration is limited. It is, for example, not greater than 2 g.

Figure 8:
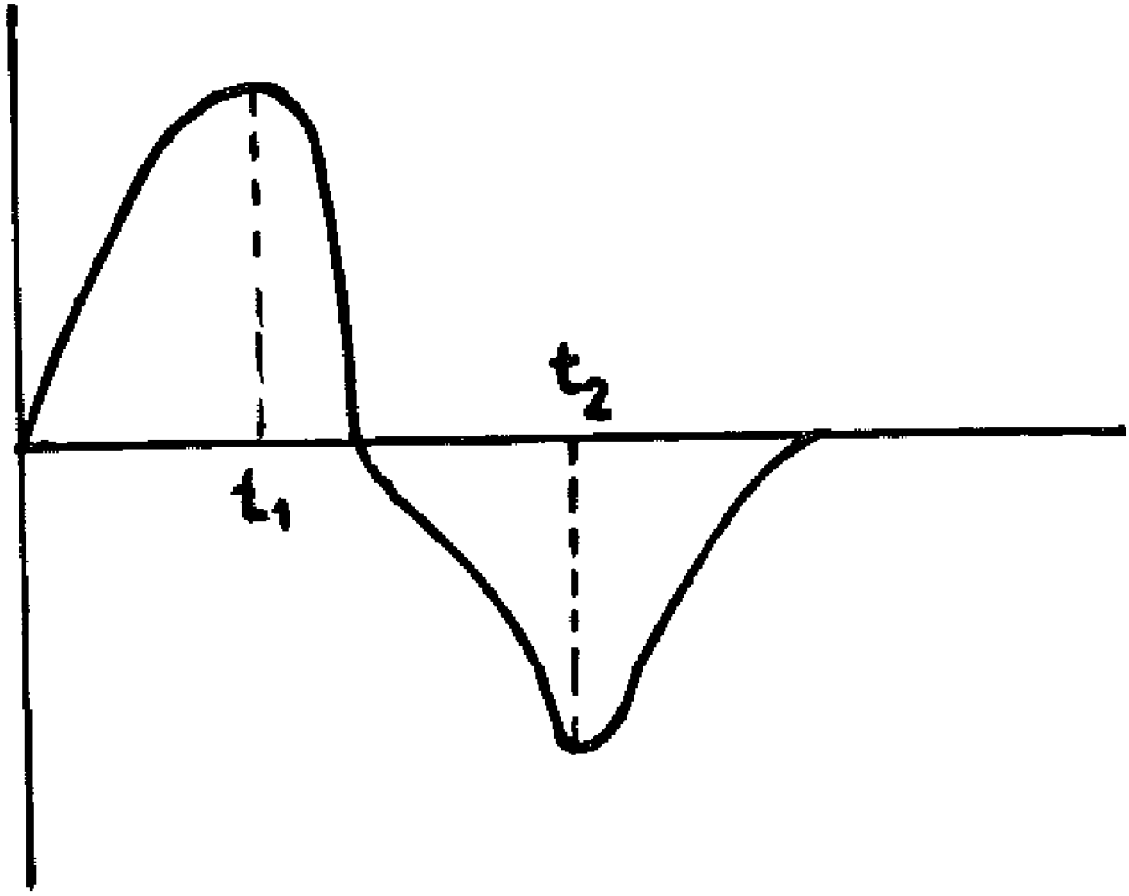
FIG. 8 is a diagram showing the acceleration of the carriage plotted against time.

Based on FIG. 8 the acceleration and braking phases of the carriage 2 will be explained in an exemplary fashion. First, the carriage 2 is in the lower position in which the passengers can enter the carriage 2 or exit it. Now the carriage 2 is accelerated to the point $t_1$. This acceleration phase can be e.g. realized across the first third of the height of the columns 1. However, almost the entire height of the columns 1 can be used for acceleration. Subsequently, the carriage 2 moves at high acceleration along the columns 1 in the downward direction. Up to point $t_2$ a weightless phase occurs because the carriage 2 is moved at very high speed and acceleration downwardly. Depending on the height of the columns 1 this weightless phase can have different durations. At the point $t_2$ the carriage 2 is braked so that it reaches at only minimal speed its lower end position.

The columns 1 can have, for example, a height of 20 to 30 meters so that a sufficiently long phase of weightlessness $t_2-t_1$ is achieved.

According to a further embodiment it is possible that the passengers in the carriage 2, for example, by means of a joystick or the like, can themselves influence the rotation or slant of the carriage 2. For example, with the aid of this joystick they can change the speed of the drives 7, 8 of the individual columns 1 so that the carriage 2 is adjusted in accordance with the wishes of the passengers. For example, by means of the joystick they can also change the speed of the ride, for example, when a phase of weightlessness is not wanted. In this case, the carriage 2 can move at only minimal speed along the columns 1 wherein a change of the slant of the carriage 2 is not necessarily required.

According to a further embodiment, it is possible that the passengers are moved with the carriage 2 into the upper end position (FIG. 6) and in this upper end position they attempt by means of a joystick or the like to keep the carriage 2 within a certain target area as the drives 7, 8 are working. For this purpose, the drives 7, 8 at the three columns 1 must be controllable by the joystick in such a way that the carriage 2 remains in the upper end position. When the passengers are not able to keep the carriage 2 in the target area by the above described manipulations, the carriage 2 by means of the drives 7, 8 is then moved downwardly along the columns 1 wherein this downward movement can be carried out with or without acceleration.

When using the joystick as described in an exemplary fashion, the drives 7, 8 are of course designed such that they can receive and process the signals sent by the joystick which signals are transmitted preferably wireless.

Instead of providing the columns 1, it is also possible to move the carriage 2 along tracks that are comprised of at least three parallel extending guides. Such tracks can be, for example, part of a roller coaster along which the carriage 2 can be moved in the described way by the drives 7, 8. The drives 7, 8 in this case are designed such that they cannot detach from their guides. For example, the drives can have support rollers that run along the guides in such a way that the drives cannot fall off the guides. While the carriage 2 is riding along the tracks, the slant of the carriage 2 can be changed in the described way as needed. Also, it is possible to vary the riding speed. For example, the passengers in the carriage 2 can change by means of a joystick or the like advantageously the riding speed and/or the slant of the carriage 2 during the ride.

The specification incorporates by reference the entire disclosure of German priority document 10 2008 005 859.9 having a filing date of Jan. 14, 2008.

While specific embodiments of the invention have been shown and described in detail to illustrate the inventive principles, it will be understood that the invention may be embodied otherwise without departing from such principles.

What is claimed is:

1. An amusement ride comprising:

guides;

at least one carriage movable along the guides;

at least three first arms each having a first end and a second end, wherein the first ends are connected pivotably to the at least one carriage;

the at least three first arms having first drives each being movable along one of the guides, respectively, independently from one another, wherein the at least three first arms are pivotably connected with the second ends to the first drives so that the at least one carriage and the first drives are pivotably connected to one another;

wherein the first ends each are pivotably connected to the at least one carriage so as to be pivotable about at least a first and a second pivot axles that are positioned angularly relative to one another;

wherein the at least three first arms each have at the first ends a connecting element that is rotatable about an axis extending in a longitudinal direction of the at least three first arms, respectively.

2. The amusement ride according to claim 1, wherein the at least three first arms each have an unchangeable length.

3. The amusement ride rides according to claim 1, wherein the connecting element is a fork structure supporting said first pivot axle.

4. The amusement ride according to claim 1, wherein the second ends each are pivotably connected to the first drives so as to be pivotable about at least a first and a second pivot axles that are positioned angularly relative to one another.

5. An amusement ride comprising guides;

at least one carriage movable along the guides;

at least three first arms each having a first end and a second end, wherein the first ends are connected pivotably to the at least one carriage;

the at least three first arms having first drives each being movable along one of the guides, respectively, independently from one another, wherein the at least three first arms are pivotably connected with the second ends to the first drives so that the at least one carriage and the first drives are pivotably connected to one another;

wherein the second ends each are pivotably connected to the first drives so as to be pivotable about at least a first and a second pivot axles that are positioned angularly relative to one another;

wherein the at least three first arms each have at the second ends a connecting element that is rotatable about an axis extending in a longitudinal direction of the at least three first arms, respectively.

6. The amusement ride according to claim 5, wherein the connecting element is a fork structure supporting said first pivot axle.

7. The amusement ride according to claim 1, wherein the at least one carriage is provided with connecting members to which the first ends of the at least three first arms are connected.

8. The amusement ride according to claim 7, wherein the connecting members each support said second pivot axle.

9. The amusement ride according to claim 7, wherein the connecting members each are a U-shaped bracket.

10. An amusement ride, comprising:

guides;

at least one carriage movable along the guides;

at least three first arms each having a first end and a second end, wherein the first ends are connected pivotably to the at least one carriage;

the at least three first arms having first drives each being movable along one of the guides, respectively, independently from one another, wherein the at least three first arms are pivotably connected with the second ends to the first drives so that the at least one carriage and the first drives are pivotably connected to one another;

wherein on the at least three first arms in a central area a second arm is pivotably connected with a first end, respectively, wherein the second arms each are connected with a second end to a second drive, respectively.

11. The amusement ride according to claim 10, wherein the first end of second arms is pivotably connected to an axle provided in said central area, which axle extends transversely to a longitudinal axis of the at least three first arms.

12. The amusement ride according to claim 10, wherein the second end of the second arm is connected to the second drive so as to be pivotable about at least a first and a second pivot axles that are positioned angularly relative to one another.

13. The amusement ride according to claim 11, wherein the second arms each have at the first end a connecting element that is rotatable about an axis extending in a longitudinal direction of the second arms, respectively.

14. The amusement ride according to claim 13, wherein the connecting element is a fork structure supported on said axle provided in said central area.

15. The amusement ride according to claim 12, wherein the second arms each have at the second end a connecting element that is rotatable about an axis extending in a longitudinal direction of the second arms, respectively.

16. The amusement ride according to claim 15, wherein the connecting element is a fork structure supporting said first pivot axle.

17. The amusement ride according to claim 10, wherein the second drives are controllable independent from one another.

18. The amusement ride according to claim 10, wherein the second drives are movably connected to the guides.

19. The amusement ride according to claim 18, wherein the second drives are linear drives.

20. The amusement ride according to claim 19, wherein the second drives are ball spindles or cable traction systems.

21. The amusement ride according to claim 1, wherein the guides are vertical columns arranged upright at corners of an imaginary triangle.

22. The amusement ride according to claim 1, wherein the guides are tracks that deviate from a vertical direction along which tracks the at least one carriage is movable.

23. The amusement ride according to claim 1, wherein the at least one carriage upon upward movement along the guides is first accelerated and after motion reversal the at least one carriage has such a high speed or acceleration for a period of time that passengers in the at least one carriage experience weightlessness.

24. The amusement ride according to claim 1, wherein the first drives are linear drives.

25. The amusement ride according to claim 24, wherein the first drives are ball spindles or cable traction systems.

* * * * *